US005666840A

United States Patent [19]

Shah et al.

[11] Patent Number: 5,666,840

[45] Date of Patent: Sep. 16, 1997

[54] METHOD FOR PIERCING TWO ALIGNED HOLES IN A HYDROFORMED TUBE

[75] Inventors: Sanjay Mahasukhlal Shah, Rochester Hills; Michael Harry Lovell, Leonard; Thomas James Malone, Shelby Township, Macomb County, all of Mich.

[73] Assignee: General Motors Corporation, Detroit, Mich.

[21] Appl. No.: 664,058

[22] Filed: Jun. 13, 1996

[51] Int. Cl.[6] ..... B21D 28/28

[52] U.S. Cl. ..... 72/55; 83/53; 72/336

[58] Field of Search ..... 72/55, 56, 336; 83/22, 53, 177; 29/421.1

[56] References Cited

U.S. PATENT DOCUMENTS

| | | | |
|---|---|---|---|
| 3,487,668 | 1/1970 | Fuchs | 75/55 |
| 3,495,486 | 2/1970 | Fuchs | 83/53 |
| 3,991,456 | 11/1976 | Lieser | 29/157 |
| 4,989,482 | 2/1991 | Mason | 83/54 X |
| 5,398,533 | 3/1995 | Shimanovski et al. | 83/53 X |
| 5,460,026 | 10/1995 | Schafer | 72/55 |

FOREIGN PATENT DOCUMENTS

484789-A 5/1992 European Pat. Off. .

*Primary Examiner*—David Jones
*Attorney, Agent, or Firm*—Patrick M. Griffin

[57] ABSTRACT

A method and apparatus for piercing a pair of aligned holes through both sides of a tube combined with the process of hydroforming the tube to final shape. After the tube is expanded and internally pressurized between upper and lower dies, a punch is driven forcefully through a cross passage in the die and through both walls of the tube, one after the other. The end of the punch is bored out sufficiently to leave a sharp edge that cuts a first slug, and the first slug is wedged into the end of the punch. The opposed wall of the tube is backed by a female die button with a cylindrical cutting edge concentric to, and equal in diameter to, the end of the punch. The end of the punch enters the die button to cleanly shear out a second hole, pushing a stack of two slugs into the die button. A pressure feed orifice properly located enters the still pressurized tube at this point, feeding positive pressure to the punch bore to blow the slugs off and out of the die button.

3 Claims, 7 Drawing Sheets

METHOD FOR PIERCING TWO ALIGNED HOLES IN A HYDROFORMED TUBE

This invention relates to tube hydroforming in general, and specifically to a method for piercing a pair of aligned holes through the tube while it is being hydroformed.

BACKGROUND OF THE INVENTION

Although not a new idea, high pressure fluid hydroforming is now finding increasing use in vehicle frame members, because of its ability to integrally form a hollow beam or the like with a complex shape that would otherwise have to be fabricated from several pieces and/or bent to shape. Typically, a round tubular blank is inserted between a pair of dies which together form an internal cavity that matches the exterior shape desired for the final part. Then the ends of the tubes are plugged and the interior of the tubular blank is highly pressurized, generally with water or hydraulic fluid, to force it out into the shape of the die cavity. Then, the completed part is depressurized and removed.

Often, various holes or openings may be desired in the wall of the final part. These may be drilled or cut after the fact, but it is also well known to incorporate the hole piercing process into the hydroforming process itself, at least when the holes are one sided. That is, when the hole is a single hole through one side only of the tube, and not a two sided hole (pair of aligned holes), such as would be formed by pushing a drill across and through both sides of the tube. There are two basic existing approaches to cutting single holes in the die, which may be termed an active and a passive process. U.S. Pat. No. 3,487,668 issued Jan. 6, 1970 to Fuchs shows the active approach. Once the tube has been pressurized internally, a sharp edged punch is pushed through a guide journal in the die and into the pressurized tube interior. Clearly, the punch must be closely enough contained within its guide journal to prevent excessive fluid leakage. The pressurized fluid inside the tube acts like an interior mandrel or support to keep the punch cutting edge from deforming and extruding the tube material inwardly to too great a degree. Still, some so called "countersinking", a slightly conical edge around the perimeter of the hole, is inevitable. This countersinking may even be desirable in the case where a screw or the like is to be inserted into the hole later, because it will act as a lead in. The slug that is cut out when the punch passes through may be handled in two ways. If the punch edge is not too sharp, then the slug may simply stick to one edge of the hole and be swung inwardly, like a hinge, without falling off into the interior of the tube. Often, this is desired, since it obviates the need to shake or wash the slug out of the tube interior later. If the punch is sharp edged, then the slug will be cut away completely and simply fall into the interior of the tube, from which it is later removed.

A variation of this active punch approach for punching single sided holes is shown in U.S. Pat. No. 4,989,482 issued Feb. 5, 1991 to Mason, some of the disclosure of which is reproduced below in FIGS. 6 and 7. In some sense, it is a solution in search of a problem, since it is claimed in the patent that then existing methods of active hole punching through the wall of an internally pressurized tube tend to leave the slug attached to the edge of the hole. While this is true for dull punches, as indicated above, the Fuchs' patent clearly shows that a sharp punch will clearly shear out a slug, although the slug tends to then fall off into the interior of the tube. The one patent claims to keep the sheared off slug stuck to the end of the punch with a suction cup action. As shown in FIGS. 6 and 7, the punch P has an end face that is machined with a large, shallow, suction cup shaped face C. The center of the shallow curved face C is vented with a small diameter, central vent passage V. The annular edge E on the end of the punch is ninety degrees at its outer diameter, where it intersects the cylindrical outer wall of the punch P, but is effectively dull overall, since it makes a very gradual and shallow transition into the shallow, cup shaped face C. This is deliberate, because what is intended, as shown in FIG. 6, is for the punch P to pierce the pressurized tube T and cut out a slug S (leaving the inevitably countersunk hole rim R) while maintaining a constant, if thin, space between the surface of the curved end face C and the back surface of the slug S. This thin space, in turn, is continually vented to atmosphere to create a claimed negative pressure differential (relative to the pressurized tube interior) that will keep the slug S suctioned onto the end of the punch P. For this space and the suction that exists in the space to be maintained, of course, the slug S cannot deform far enough inwardly to abut the curved face C. The continual suction is described as evening out the shear force so that the slug S is cleanly cut, rather than to be left adhering to the edge of the hole like a lid on the edge of a can. While it is questionable that this suction action is needed simply to cleanly shear off a slug like S (a sharp edged punch will do that much), the ultimate objective is really to flatten out, from the inside, the slightly countersunk hole rim R. This is achieved because the adhered slug S is slightly greater in diameter than the punch edge E, overlapping it and leaving a narrow, but noticeable residual ring of width delta. This wider slug S, since it is sucked onto the end of punch P, can be backed up along with punch P and against the edge rim R, flattening it, so it is claimed.

The method just described is of dubious utility because, if the desired objective is simply to create a flat edged hole without the countersunk rim R, then a preferable method for doing so, in many cases, is the passive method of hole punching. As shown in co assigned U.S. Pat. No. 5,398,533 to Shimanovski et al, a flat edged hole may be cut by letting the internal of the internal fluid blow a hole through the tube wall from the inside out, through a sharp edged female die that abuts the outside of the tube and acts as a template. A plunger acting as a backup support of the tube wall within the die is pulled back when the pressure is sufficient, thereby leaving the tube wall unsupported over the die and allowing the hole to be blown through. The slugs are then ejected through a special mechanism. This patent shows an improvement of a far older apparatus for passive cutting disclosed in U.S. Pat. No. 3,495,486. There, a tube is internally pressurized for the sole purpose of passively cutting a hole with a plunger backed female die button, although some of the structural features of the apparatus could be applied to in die piercing combined with hydroforming. There is a recognition in the '486 patent that a cut slug can be deformed and wedged up tightly into the concave end of a sharp edged plunger, as shown in FIG. 8 of the patent, where a slug 156 is bowed into the sharp edged concave face of a plunger 138 and inside of a concentric hole in a sliding sleeve 114. The sleeve 114 then has to be pulled in order to eject the slug 156. In general, passive punching can be used where the hole is large enough to in turn present enough unsupported area across a female die button to be blown out. It also presents special sealing problems in that excessive loss of the highly pressurized fluid has to be prevented. Active punching is less sensitive to leakage and pressure losses, since the male punch is quickly and forcibly pushed through the tube, and pressure loss will not jeopardize its cutting action. Neither method and apparatus could be easily applied to punching two aligned holes in a tube, however, unless both dies contained enough room to have two identical apparatuses (punches or plunger backed die buttons) arrayed in an opposed relationship. Neither method used alone could provide two aligned holes in which one hole had a countersunk rim, and the other was flat edged, if that was the ultimate goal.

SUMMARY OF THE INVENTION

The invention provides a new method and apparatus that can easily punch aligned, first and second holes nearly simultaneously, one through each side of an internally pressurized tube, both of which are actively punched by the same tool, while using the internal tube pressure both as backing support when the first hole is punched, and also as part of a unique slug ejection mechanism after both holes have been cut.

In the embodiment disclosed, the upper and lower dies are provided with a cross passage generally perpendicular to the tube, through which a punch can be driven so as to pass completely through both the upper and lower walls of the tube. The lower portion of the cross passage is provided with a female die button having a cylindrical cutting edge equal in diameter to the second hole to be pierced in the tube, and a predetermined axial thickness. The die button is not backed by a plunger, however, since it is not used as a passive blow out template.

A specially designed punch long enough to pass through both sides of the tube and at least most of the way through the die button's axial thickness is located initially in the upper portion of the die cross passage, above the tube. The cylindrical end of the punch has an outer diameter equal to the inner diameter of the die button, and is relieved with a wide central bore that is large enough to leave a surrounding annular cutting edge. The annular cutting edge is sufficiently radially thin and sharp to cleanly cut a round slug out of the pressurized tube wall, but not so sharp as to be subject to chipping. The narrow annular cutting edge also makes a sharp transition into the central bore across a conical chamfer, as opposed to a shallow, gradual transition. Cut through the side of the punch, at a point spaced above the cutting edge by a distance that is equal to the tube diameter plus most of the thickness of the die button, is a small diameter pressure feed orifice, which opens into the central bore. In the embodiment disclosed, the outer diameter of the punch widens considerably across a stepped shoulder, at a point about midway between the end of the punch and the pressure feed orifice.

In operation, the tube is clamped between the upper and lower dies, pressurized, and formed to shape. Then, the punch is driven forcefully and through the upper part of the cross passage and toward the pressurized tube until the end pierces the upper wall of the tube, shearing out a first slug and leaving an upper hole of roughly equal diameter with a slightly countersunk rim. Because of the thinness of the annular punch cutting edge and the sharpness of its transition into the wide central bore, the first slug is deformed by both the impact force of the punch and the internal tube pressure up into the central bore. The first slug mechanically wedges into the end of the bore, and does not fall off into the tube interior. Also, the circular outer edge of the sheared first slug is kept clear of and does not radially overlap with the outer diameter of the annular cutting edge. As the punch end and retained first slug travel through the tube interior toward the tube lower wall, the stepped shoulder is simultaneously pushed through the tube upper wall, enlarging the original upper hole considerably and extruding the countersunk rim inwardly into a short cylindrical sleeve. The tube wall thickness and the diameter of the female die button are such that the interior pressure of the tube is not sufficient alone to blow a second slug out through the die button.

When the punch end (and retained first slug) impact the tube lower wall, a second slug equal in diameter to the die button inner diameter is cut cleanly by the shearing action of the male punch end entering the concentric edge of the female die button. The second slug is pushed by the first slug into the die button in a stacked pair. The support of the die button surrounding the rim of the second hole assures that the second hole is flat and sharp edged. The lack of radial overlap between the first slug and the punch cutting edge assures that none of the first slug is sheared off by the die button and left inside the tube. Just before the end of the punch with its stacked pair of sheared slugs exits the die button, the punch's pressure feed orifice is pushed down through the widened first hole and into the still pressurized tube interior. This allows pressurized fluid to be pumped into the central bore of the punch to hit the back of the first slug and blow it and the stacked second slug off of the end of the punch and out of the die button. The tube is then quickly de pressurized.

DESCRIPTION OF THE PREFERRED EMBODIMENT

These and other features of the invention will appear from the following written description and from the drawings, in which.

Figure 1:
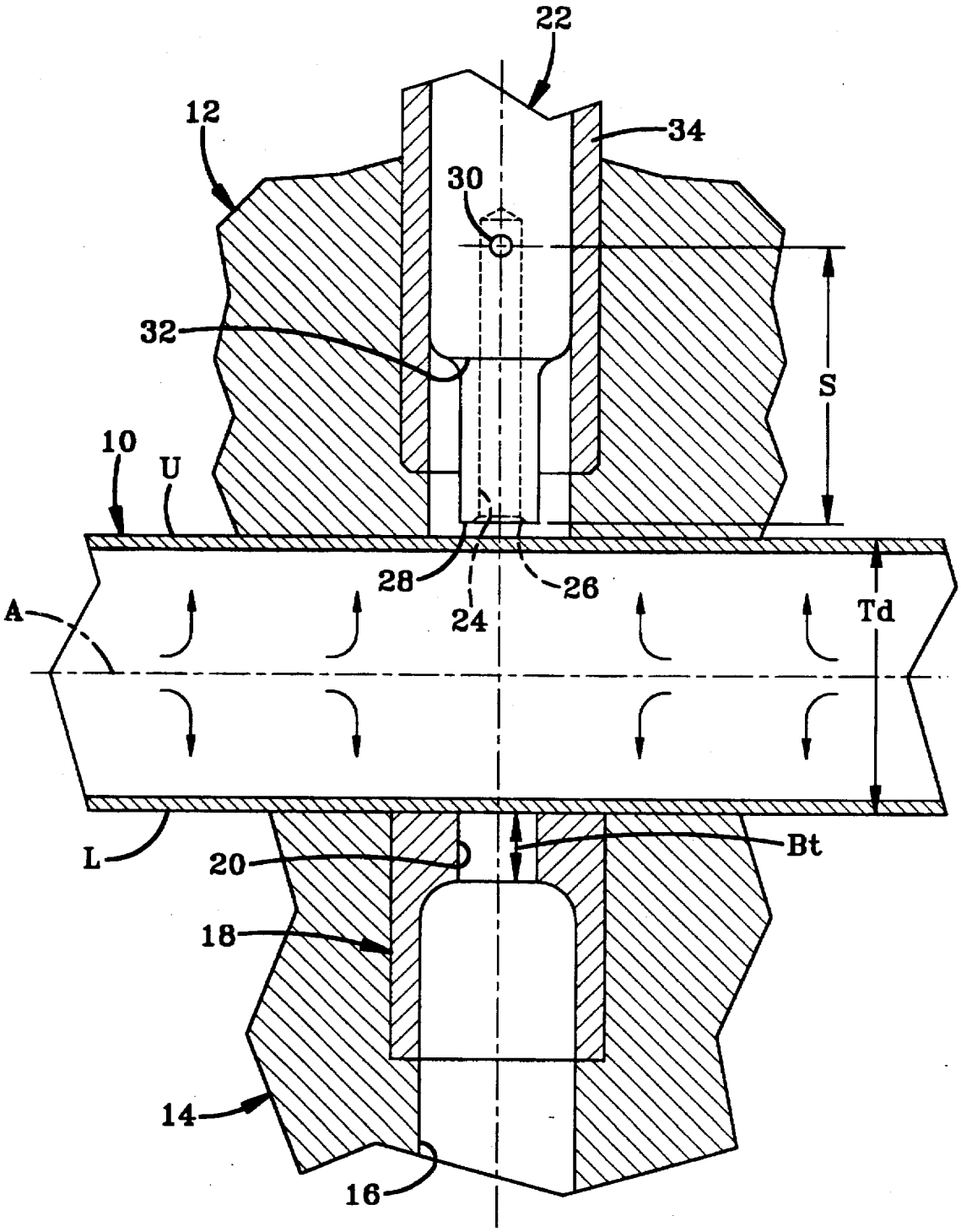
FIG. 1 is a cross section through upper and lower dies showing an internally pressurized tube before the punch has been moved.

Referring first to FIG. 1, a cylindrical tube indicated generally at 10 is shown as already expanded out to its final, predetermined diameter, indicated at Td, measured between upper and lower walls of tube 10 that are indicated at "U" and "L". The tube walls have a thickness of approximately one tenth inches. Now, "diameter" should be read broadly enough to indicate more than just a cylindrical tube. More often than not, tube 10 will be expanded out from a cylindrical blank to a shape with a more or less rectangular cross section, with flat upper and lower walls. There would be little point in hydroforming a cylindrical blank out into simply a larger cylinder. By the same token, however, "upper" and "lower" wall should be read broadly enough to cover even two sides of a cylindrical tube with no distinct upper and lower walls as such. "Upper" and "lower" are only illustrative, since the tube 10 could be oriented vertically. The basic objective is to cut two holes that are directly on opposite sides of the central axis A of tube 10, so that another structural member can be later inserted through the aligned holes, through both sides of tube 10 and generally perpendicular thereto. The other member, such as a bolt supporting sleeve or the like, is then fixed to tube 10 solidly by welding so that the tube 10 can in turn be attached to form part of a larger structure, such as a multi piece frame or engine cradle..

Still referring to FIG. 1, tube 10 has been formed to shape by clamping it between upper and lower dies 12 and 14 then internally pressurizing, sometimes as high as 10,000 psi as disclosed. The dies 12 and 14 are provided with a cross passage 16 that runs perpendicularly across the tube 10, meeting both walls thereof. The lower portion of cross passage 16 contains a female die button, indicated generally at 18, which abuts the tube lower wall L. Button 18 has a cylindrical cutting edge 20 with an inner diameter that matches the hole to be pierced through tube lower wall L, about 0.59 inches in the embodiment disclosed, and a predetermined axial thickness indicated at Bt. Again, "diameter" should be read broadly enough to indicate the main dimension of a hole of any shape, not just circular, though that is the most common. The unsupported area inside of cutting edge 20 is insufficient, at the particular wall thickness and internal pressure used, to passively blow a slug through the button 18. Therefore, an active hole punching technique must be used.

Figure 8:
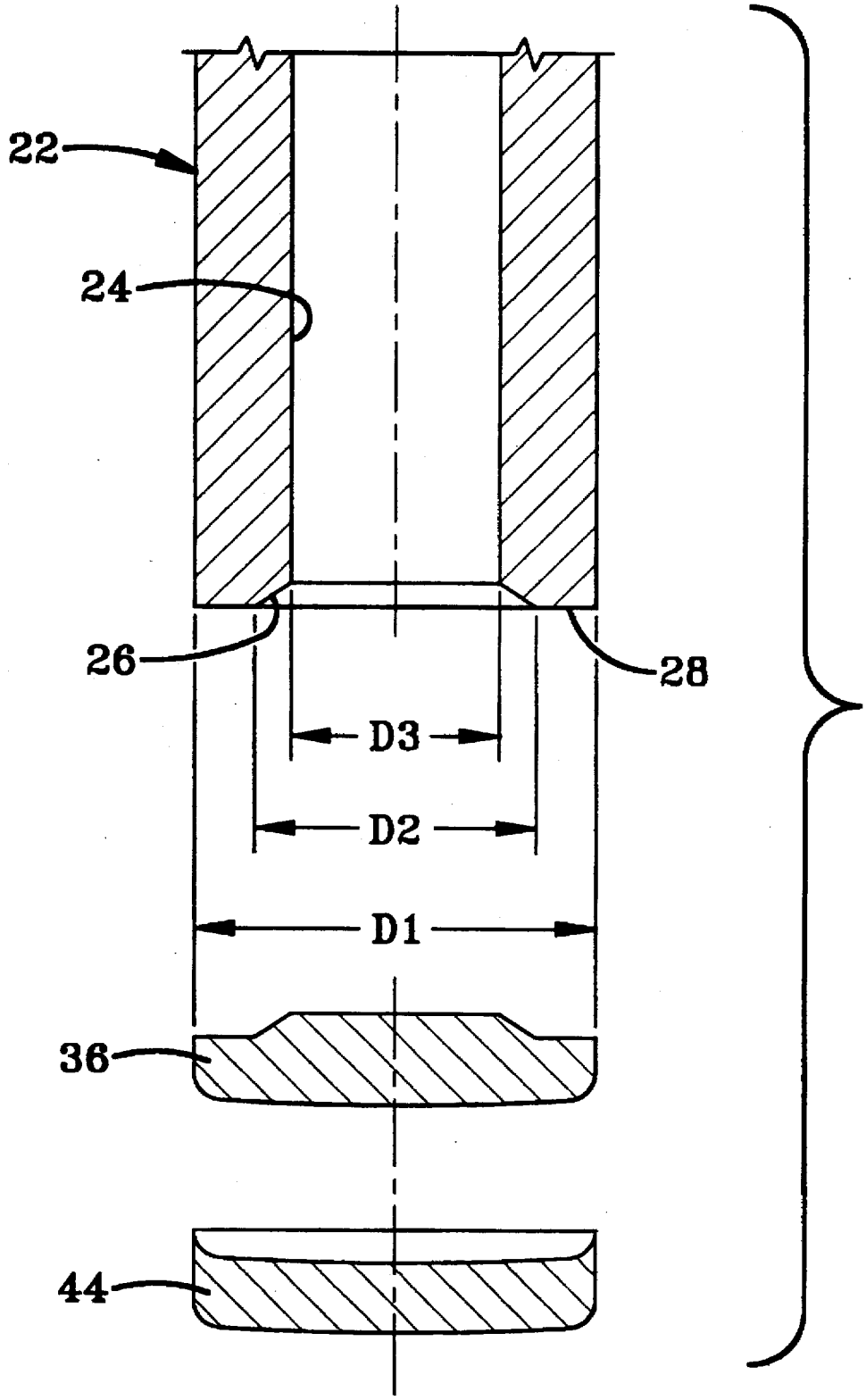
FIG. 8 is an enlargement of the end of the punch of the invention with the two slugs shown spaced out in from of the end of the punch for comparison.

Referring next to FIGS. 1 and 8, the primary tool used in the apparatus is a stepped diameter cylindrical male punch, indicated generally at, 22, which is machined from a suitable tool steel. Punch 22 has a cylindrical end with an outer diameter D1 equal to the die button cutting edge 20, that is, approximately 0.59 inches. The end of punch 22 is machined with a specific and deliberate concave shape designed to cut and retain a slug in a very particular way. A wide central cross bore 24 with a diameter D3 of approximately 0.34 inches is machined into the end of punch 22 an along the central axis for a short distance that is just greater than the axial dimension S indicated in FIG. 1, and described further below. In general, the length of bore 24 is not a large fraction of the total length of punch 22. The edge of bore 24 is beveled off at a fairly sharp, thirty degree chamfer 26 to leave a flat, annular edge 28 with an inner diameter D2 of approximately 0.49 inches. Consequently, annular cutting edge 28 is relatively radially narrow, only approximately 0.05 inches as disclosed. This narrow width, combined with the sharp, abrupt transition down into the wide central bore 24, is important to its operation. Drilled into the side of punch 22, and into the end of the central bore 24, is a small diameter (about ⅛ inch) pressure feed orifice 30, which is axially spaced from the end of punch 22 by a distance S that is equal to the expanded tube diameter Td plus most of the die button thickness Bt. This relation of S to the predetermined Td and Bt allows orifice 30 to operate in a fashion described below. In the embodiment disclosed, punch 22 has a stepped shoulder 32 with a diameter almost twice that of the end of the punch 22. Therefore, the upper portion of cross passage 16 is wide enough to accommodate the wider shoulder 32, and is also lined with a bronze sleeve bearing 34 that fits closely, but slidably, around the shoulder 32.

Figure 2:
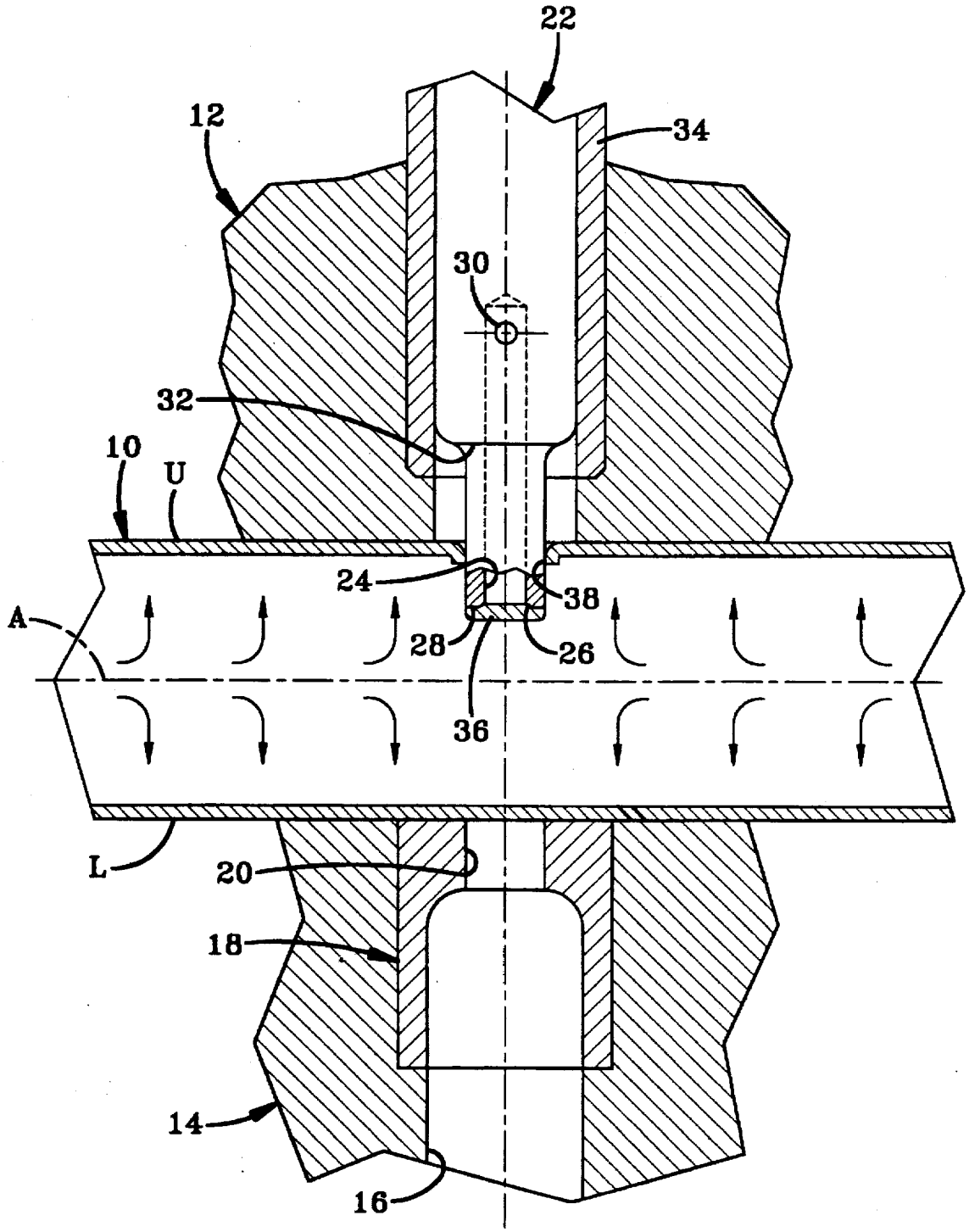
FIG. 2 shows the punch after it has been pushed through the upper wall of the tube, created a first hole and removed a first slug.

Referring next to FIGS. 2 and 8, the initial operation of punch 22 is illustrated. It should be kept in mind that while the process is arbitrarily broken down into discrete steps for purposes of illustration fact the punch 22 is pushed through the cross passage 16 very rapidly and forcefully, with about 17,000 pounds of force and an initial velocity of approximately 0.33 feet per second. Both walls U and L are cut quickly, in about 2 to 3 seconds. Initially, the punch cutting edge 28 breaks through the tube upper wall U, piercing a round first slug 36, supported by the tube internal pressure, and leaving behind an upper round hole 38 with the distinctive slightly countersunk rim. Any pressurized internal tube fluid that escapes past the edge of the hole 38 is well blocked by the close fit of the bearing sleeve 34 around the outer surface of the punch shoulder 32, and loss of tube pressure is minimized because of the short cycle involved. In terms of initial punch breakthrough and the cutting of the hole 38 per se, the operation is very like that shown with the sharp edged punch in the Fuchs U.S. Pat. No. 3,487,668. However, the cut slug 36 does not fall out into the interior of tube 10, as it does there. Nor is it suctioned flat to the end of punch 22 to overlap the cutting edge 28, as in the Mason patent. Instead, as best seen in FIG. 8, the force of impact of the end of the rapidly moving punch 22 against the outer surface of the tube wall U, coupled with the internal tube pressure pushing on the inner surface of upper wall U, serves to press and deform the slug 36 into the end of punch 22. Specifically, the inner surface of slug 36 (which was the outer surface of upper tube wall U) is plastically deformed to an extent into end of the concave central bore 24 and tight against the conical chamfer 26, leaving a distinct matching impression. The slug 36 is physically wedged and jammed into the end of punch bore 24, so that it adheres, assisted by the inward force of the tube internal pressure. The slug retention force is not a suction action per se, since the pressure feed orifice 30 is not deliberately exposed to atmospheric pressure, and is essentially blocked by the close fit of the sleeve 34 over it, anyway. While little positive pressure would leak in behind the slug 36, since it is wedged so tightly into the end of the central bore 24, any negative pressure differential that is thereby maintained behind slug 36 is incidental, and the slug 36 would be retained just as well even if the central bore 24 were only as long as needed to accommodate the inward plastic deformation of slug 36. Bore 24 is longer than necessary just to accommodate slug deformation, but not so as to allow for the maintenance of a negative pressure differential behind slug 36. Instead, exactly the opposite is done, as will appear below. Another important consequence of the deformation of slug 36 into the bore 24 and tightly against the chamfer 26, as best seen in FIG. 8, is that the outer edge of slug 36 is thereby kept radially clear of the outer diameter of the punch annular cutting edge 28, or at least does not overlap therewith, as in the Mason patent. In addition, the edge or "corner" of the outer surface of the slug 36 is rounded or radiused slightly by the pressure within tube 10 as it is cut out. Both aspects of slug 36 are significant to the cutting of the second, aligned hole.

Figure 3:
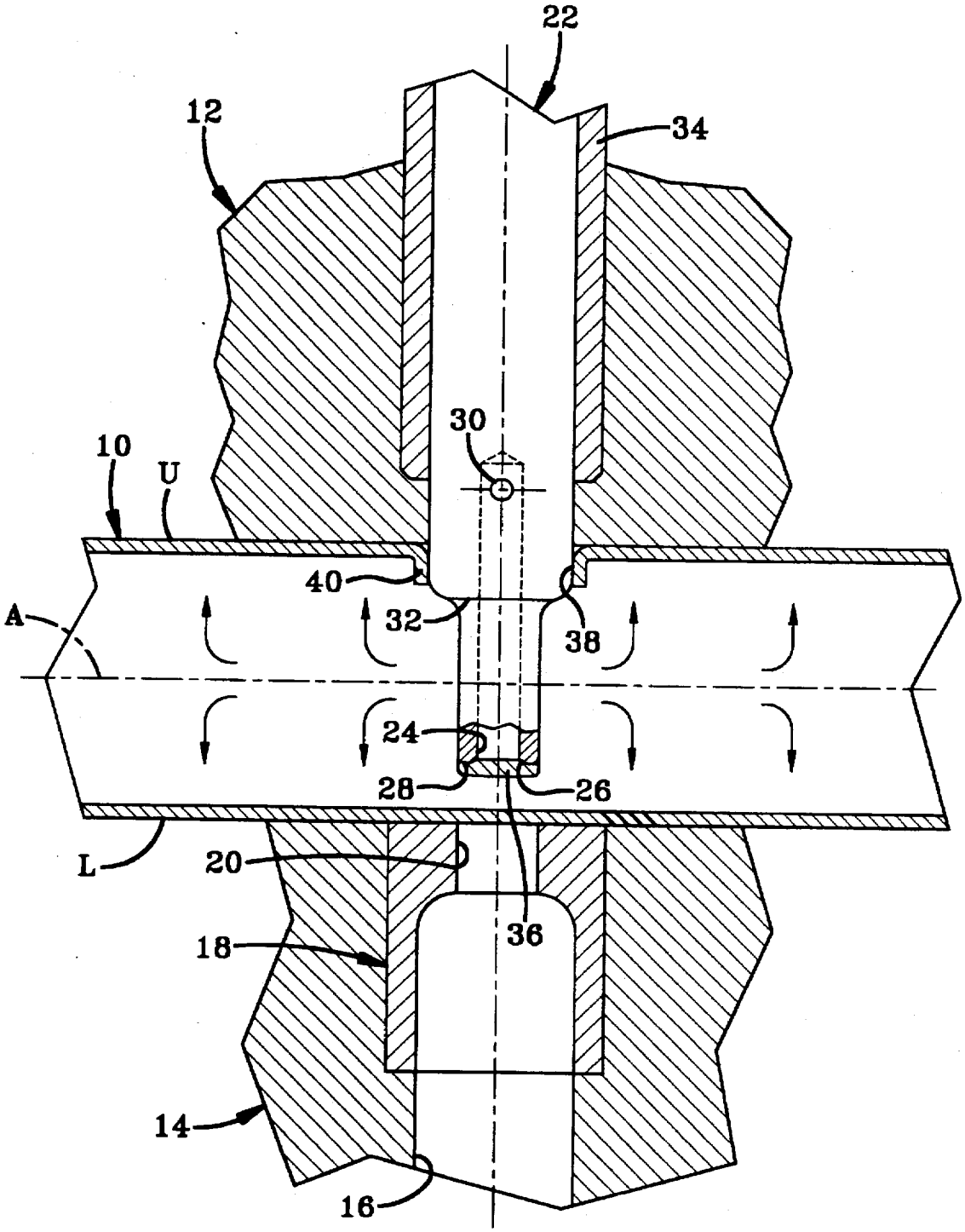
FIG. 3 shows the end of the punch moving through the tube interior and toward the lower wall of the tube as the stepped shoulder of the punch passes through the upper tube wall to widen the upper hole.

Referring next to FIG. 3, an additional feature of the particular embodiment of punch 22 disclosed here is illustrated. Before the end of punch 22 reaches the tube lower wall L, the shoulder 32 engages the upper wall U concentric to the initial upper hole 38. The radiused edge of punch shoulder 32 enters and widens the hole 38 to almost twice it's original diameter, concurrently extruding the tube wall material surrounding hole 38 inwardly and into a short concentric cylindrical sleeve 40. This is in direct contravention to what a passive hole forming technique does, or what the modified active hole punching method of Mason does, both of which leave a fattened inner rim surrounding the punched hole. The reason for this difference is that, ultimately, the end of another structural member, such as a sleeve, will be inserted through the aligned holes in the tube 10. The countersunk rim and extruded concentric sleeve 40 of the first hole 38 can act as a guiding lead in for a sleeve of the like as it is inserted and also provide welding support for fixing the sleeve to the tube 10.

Figure 4:
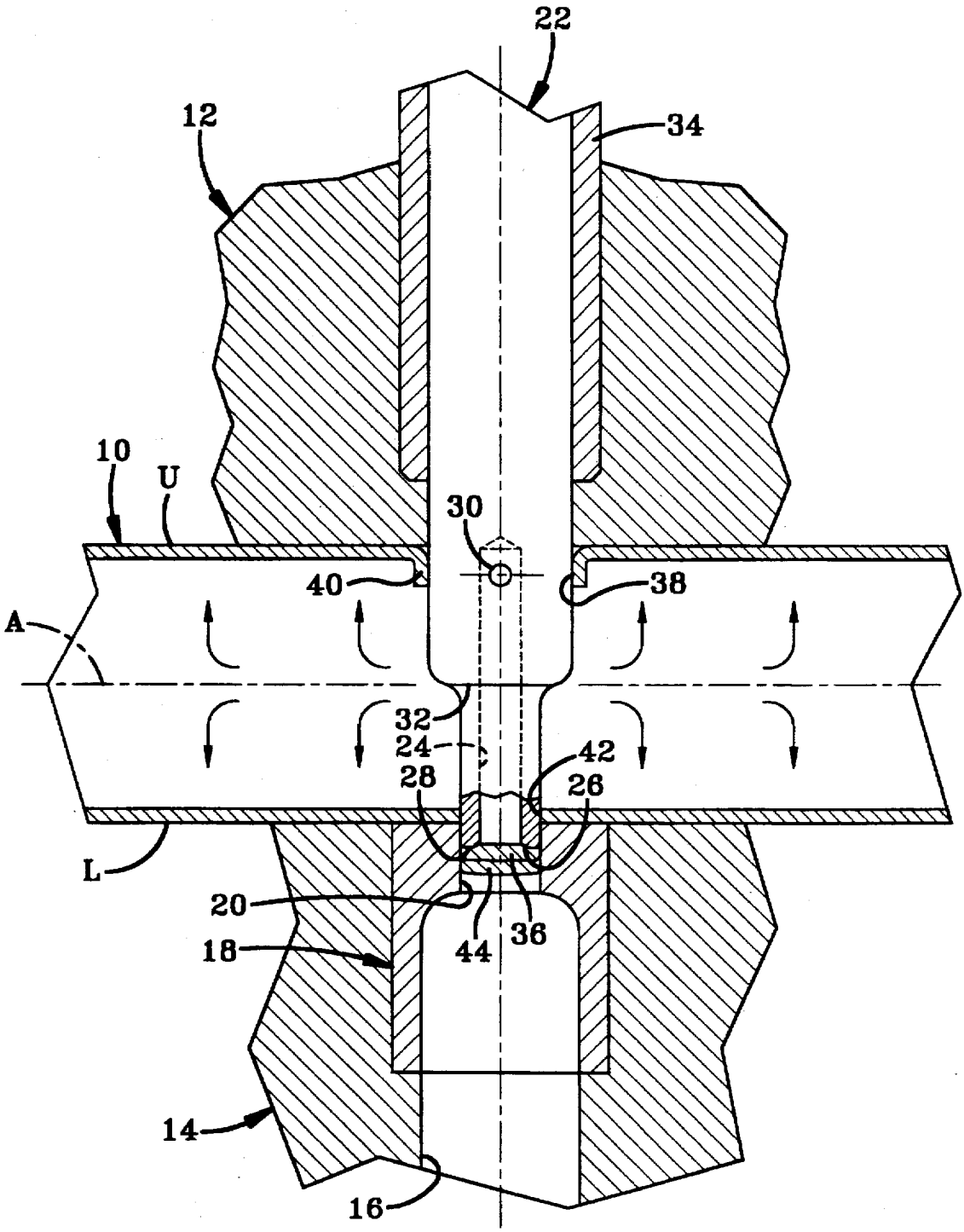
FIG. 4 shows the punch end passing through the tube lower wall and entering partially into the die button to cut a second hole and second slug.

Referring next to FIGS. 4 and 8, a second, lower hole 42 aligned with the first hole 38 is cut when the end of punch 22 hits the tube lower wall L. Specifically, the radiused corner edge of the outer surface of the first slug 36 forcefully impact the inner surface of the lower tube wall L, concentric to die button 18 and its cylindrical cutting edge 20. This creates a shearing or scissoring action as the end of punch 22 passes into the die button edge 20, cleanly cutting a second slug 44 that stacks on top of the first slug 36 and is dragged along and into the interior of the die button 18. As best seen in FIG. 8, the edge of the inner surface of the second slug 44 is smeared inwardly to an extent over the radiused corner edge of the outer surface of the first slug 36. This creates a tightly abutted sandwich of two stacked slugs 36 and 44, as best seen in FIG. 4. The shearing action of the male punch 22 passing through the female die button edge 20, and the solid support of the die button 18, creates a very flat rimmed and sharp edged second hole 42 faster and more cleanly than either the active or passive methods of piercing described above can do. While it is the first slug 36 that directly hits the inner surface of the lower tube wall L, and not the punch cutting edge 28, the high impact force of the rapidly moving punch 22 and the cooperating support of the surrounding die button 18 are sufficient to shear out the second hole 42 regardless. It is also thought that the radiused corner edge of the outer surface of the first slug 36 acts as a lead in to assist entry through the die button edge 20. Just as significant, the fact that the first slug 36 does not radially overlap the punch cutting edge 28, even though it does cover most of it, means that there is no surrounding ring of residual metal on first slug 36 that would retard entry through the die button edge 20, or perhaps even be cut off to leave a ring of excess material inside the tube 10.

Figure 5:
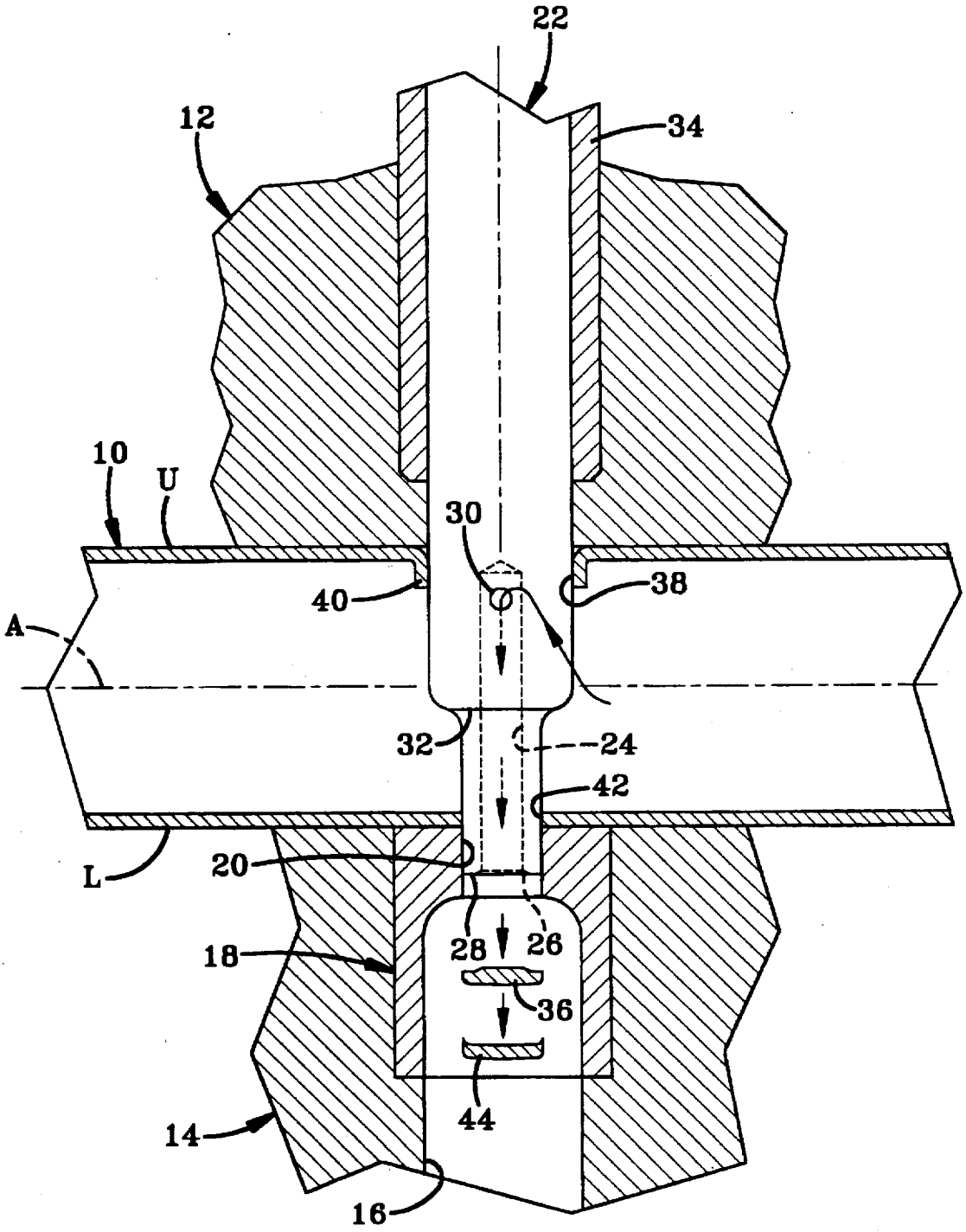
FIG. 5 shows the punch most of the way through the die button, as the pressure feed orifice is exposed to the interior of the tube and pressurized fluid enters the punch cross bore to dislodge the stacked slugs and eject them.
Figure 6:
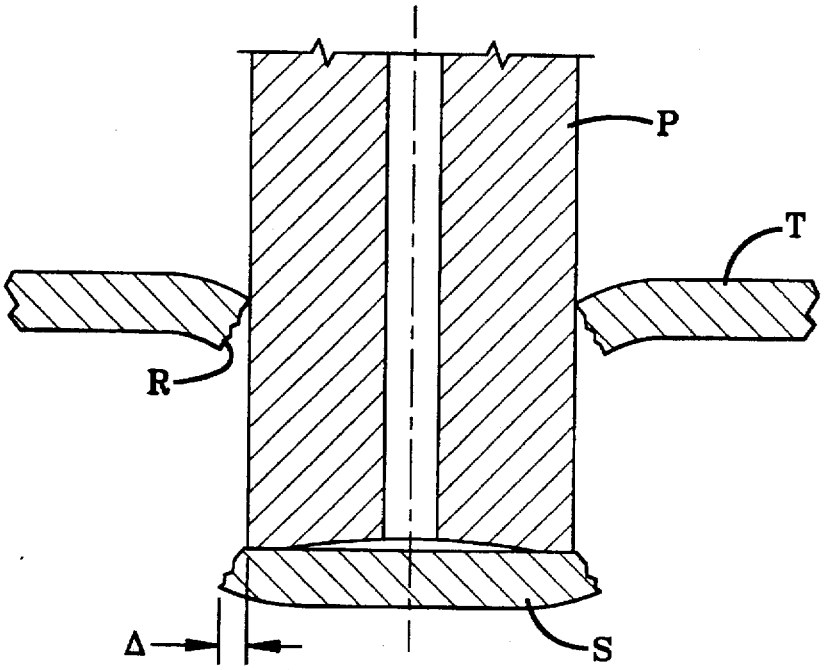
FIG-6 PRIOR ART
FIG. 6 is a view of the prior art punch and piercing process described above.
Figure 7:
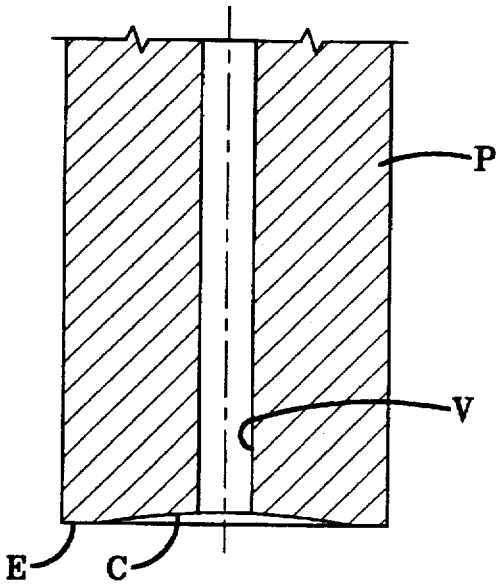
FIG-7 PRIOR ART
FIG. 7 is a view of just the end of the prior art punch described above.

Referring next to FIG. 5, the final step in the cutting process is illustrated, which is the removal of the stacked slugs 36 and 44. It will be recalled that the first slug 36 is jammed tightly into the end of the punch's central bore 24, and it and the stacked second slug 44 are pushed tightly inside the die button cylindrical edge 20. Even if the end of the punch 22 passed all the way through the die button 18, allowing at least the outer slug 44 to fall off, it is not assured that the wedged inner slug 36 would also fall off. Nor is it certain that the end of the punch 22 would always pass completely through the die button 18. Therefore, to assure certain slug ejection, the pressure feed orifice 30 now enters the interior of tube 10, below the upper wall U. This is assured by the fact of placing of orifice 30 at a distance S from the end of punch 22 that is no more the tube diameter Td, plus a portion of the die button thickness Bt, as noted above. At that point, the empty central bore 24 behind the first slug 36, even though it was not needed as a space for a negative pressure differential to hold first slug 36, does serve the opposite purpose. A highly positive pressure differential is created, since the inside of the die button 18 is at atmospheric pressure, while fluid from the interior of tube 10 is still pressurized. Consequently, fluid rushes through the orifice 30 and into the tube central bore 24. This blows at least the first slug 36 out of the concave end of punch 22, and, if necessary, blows both of the stacked pair of slugs 36 and 44 out of the inside of the die button 18, as shown in FIG. 5. While the tube interior pressure is not high enough to achieve a passive hole cutting, it is still utilized.

Variations in the disclosed method could be made. Theoretically, the process could be used even on a tube that was not being concurrently expanded by hydroforming. That is a hollow tube could be supported between dies, sealed and pressurized for the sole purpose of cutting the aligned holes. The primary advantage of the process, economically, is its incorporation into the hydroforming process, however. As already noted, hole shapes other than circular could be cut, by a punch that had a matching non circular shape. It would then become critical to angularly align the end of the punch to the profile of the die button, of course. It would not be necessary to provide the punch with a widened shoulder like 32, if aligned holes of the same diameter were desired. With a single diameter punch, the basic operation would be the same, but the upper hole would be substantially equal in size to the second, though not as flat, and would lack the extruded surrounding sleeve 40. Therefore, it will be understood that it is not intended to limit the invention to just the embodiment disclosed.

We claim:

1. A method for concurrently punching first and second aligned holes through opposed walls of a tube, comprising the steps of;

internally pressurizing said tube between a pair of dies, providing said dies with a cross passage generally perpendicular to said tube through which a punch can be pushed, providing one side of said cross passage with a female die button having an inner diameter equal to the second hole desired and having a predetermined axial thickness, providing the end of a male punch having an outer diameter equal to said female die button inner edge with a central bore sufficiently large to leave a surrounding annular cutting edge that is sufficiently radially thin and sharp both to cleanly cut a slug of material equal in diameter to said cutting edge as well as allowing said slug to be deformed by the internal pressure within said tube up into said punch central bore and clear of said cutting edge, forming a pressure feed orifice through the side of said punch and into said punch central bore that is axially spaced from said punch end by approximately said tube diameter plus a portion of said die button predetermined thickness, clamping said tube between said dies and internally pressurizing it to said predetermined diameter, pushing said punch through said cross passage and into said tube interior, thereby cutting a first slug equal in diameter to said cutting edge allowing said first slug to be deformed by said tube internal pressure into said punch cross bore sufficiently to cause said first slug to be wedged into said cross bore while leaving said punch cutting edge substantially clear, pushing said punch end partially into said die button, thereby shearing a second slug equal in diameter to said die button which stacks closely against said first slug and is forced into said die button, and, continuing to push said punch and stacked first and second slugs through said die button until said pressure feed orifice enters said tube interior, thereby allowing pressurized fluid from said tube interior to hit the back side of said first slug and thereby blow both slugs away out of and away from said punch end.

2. A method for concurrently punching first and second aligned holes through opposed walls of a tube while hydroforming said tube to a predetermined diameter by internally pressurizing said tube between a pair of dies, comprising the steps of;

providing said dies with a cross passage generally perpendicular to said tube through which a punch can be pushed, providing one side of said cross passage with a female die button having an inner diameter equal to the second hole desired and having a predetermined axial thickness, providing the end of a male punch having an outer diameter equal to said female die button inner edge with a central bore sufficiently large to leave a surrounding annular cutting edge that is sufficiently radially thin and sharp both to cleanly cut a slug of material equal in diameter to said cutting edge as well as allowing said slug to be deformed by the internal pressure within said tube up into said punch central bore and clear of said cutting edge, forming a pressure feed orifice through the side of said punch and into said punch central bore that is axially spaced from said punch end by approximately said tube diameter plus a portion of said die button predetermined thickness, clamping said tube between said dies and internally pressurizing it to said predetermined diameter, pushing said punch through said cross passage and into said tube interior, thereby cutting a first slug equal in diameter to said cutting edge allowing said first slug to be deformed by said tube internal pressure into said punch cross bore sufficiently to cause said first slug to be wedged into said cross bore while leaving said punch cutting edge substantially clear, pushing said punch end partially into said die button, thereby shearing a second slug equal in diameter to said die button which stacks closely against said first slug and is forced into said die button, and, continuing to push said punch and stacked first and second slugs through said die button until said pressure feed orifice enters said tube interior, thereby allowing pressurized fluid from said tube interior to hit the back side of said first slug and thereby blow both slugs away out of and away from said punch end.

3. A method for concurrently punching first and second aligned holes through opposed walls of a tube while hydroforming said tube to a predetermined diameter by internally pressurizing said tube between a pair of dies, comprising the steps of;

providing said dies with a cross passage generally perpendicular to said tube through which a punch can be pushed, providing one side of said cross passage with a female die button having an inner diameter equal to the second hole desired and having a predetermined axial thickness, providing the end of a male punch having an outer diameter equal to said female die button inner edge with a central bore sufficiently large to leave a surrounding annular cutting edge that is sufficiently radially thin and sharp both to cleanly cut a slug of material equal in diameter to said cutting edge as well as allowing said slug to be deformed by the internal pressure within said tube up into said punch central bore and clear of said cutting edge, forming a pressure feed orifice through the side of said punch and into said punch central bore that is axially spaced from said punch end by approximately said tube diameter plus a portion of said die button predetermined thickness, providing said punch with a widened shoulder located midway between said punch end and said pressure feed orifice, clamping said tube between said dies and internally pressurizing it to said predetermined diameter, pushing said punch through said cross passage and into said tube interior, thereby cutting a first slug equal in diameter to said cutting edge allowing said first slug to be deformed by said tube internal pressure into said punch cross bore sufficiently to cause said first slug to be wedged into said cross bore while leaving said punch cutting edge substantially clear, continuing to push said punch through said tube interior to push said shoulder through said first hole, thereby widening it and extruding a short sleeve surrounding said first hole, pushing said punch end partially into said die button, thereby shearing a second slug equal in diameter to said die button which stacks closely against said first slug and is forced into said die button, and, continuing to push said punch and stacked first and second slugs through said die button until said pressure feed orifice enters said tube interior, thereby allowing pressurized fluid from said tube interior to hit the back side of said first slug and thereby blow both slugs away out of and away from said punch end.

* * * * *